US010161171B2

(12) United States Patent
Lin et al.

(10) Patent No.: US 10,161,171 B2
(45) Date of Patent: Dec. 25, 2018

(54) SLIDING RAIL TYPE LOW-OBSTACLE LINKAGE SHOWER ROOM AND INSTALLATION METHOD

(71) Applicant: FUJIAN XIHE SANITARY WARE TECHNOLOGY CO., LTD., Nan'an (CN)

(72) Inventors: Xiaofa Lin, Nan'an (CN); Xiaoshan Lin, Nan'an (CN); Jilun Pang, Nan'an (CN); Pengxing Zheng, Nan'an (CN); Qiqiao Liu, Nan'an (CN); Xiaoqing Deng, Nan'an (CN)

(73) Assignee: FUJIAN XIHE SANITARY WARE TECHNOLOGY CO., LTD., Nan'an (CN)

( * ) Notice: Subject to any disclaimer, the term of this patent is extended or adjusted under 35 U.S.C. 154(b) by 17 days.

(21) Appl. No.: 15/592,168

(22) Filed: May 10, 2017

(65) Prior Publication Data

US 2017/0328106 A1 Nov. 16, 2017

(30) Foreign Application Priority Data

May 12, 2016 (CN) ..... 2016 1 0313071

(51) Int. Cl.

| | |
|---|---|
| ***E05D 15/06*** | (2006.01) |
| ***A47K 3/34*** | (2006.01) |
| ***E06B 3/46*** | (2006.01) |
| ***E05F 17/00*** | (2006.01) |

(52) U.S. Cl.

CPC ..... *E05D 15/0647* (2013.01); *A47K 3/34* (2013.01); *E05D 15/0626* (2013.01); *E05D 15/0656* (2013.01); *E05F 17/00* (2013.01); *E06B 3/4681* (2013.01); *E05D 15/0634* (2013.01); *E05F 2017/007* (2013.01); *E05Y 2201/638* (2013.01); *E05Y 2201/716* (2013.01); *E05Y 2201/722* (2013.01); *E05Y 2800/122* (2013.01); *E05Y 2800/268* (2013.01); *E05Y 2800/672* (2013.01); *E05Y 2900/114* (2013.01)

(58) Field of Classification Search

CPC ..... A47K 3/34
USPC ..... 4/607, 596
See application file for complete search history.

(56) References Cited

U.S. PATENT DOCUMENTS 4,785,485 A * 11/1988 Etesam ..... A47K 3/34 4/557
4,903,433 A * 2/1990 Baus ..... A47K 3/362 49/40
5,657,581 A * 8/1997 Husting ..... A47K 3/34 4/607

(Continued)

*Primary Examiner* — Lori Baker
(74) *Attorney, Agent, or Firm* — Gokalp Bayramoglu

(57) ABSTRACT

A sliding rail low-obstacle linkage shower room include an upper rail and a lower rail, a fixed glass, a primary shower glass and a secondary shower glass. The lower rail is correspondingly fixed on a bottom of the secondary shower glass. A sliding block unit is installed on the lower rail. The sliding block unit includes a fixed portion, a sliding groove and a guidance sliding portion. The fixed portion is fixed on the bottom of the secondary shower glass. A bottom of the primary shower glass is inserted into the sliding groove to form a linkage. The guidance sliding portion is glidingly engaged with the lower rail. The linkage shower room has a simple structure which can be easily manufactured.

10 Claims, 11 Drawing Sheets

(56) References Cited

U.S. PATENT DOCUMENTS

| | | | | | |
|---|---|---|---|---|---|
| 5,852,837 | A * | 12/1998 | Husting | A47K 3/34 | 4/607 |
| 5,911,519 | A * | 6/1999 | Eutebach | A47K 3/362 | 4/607 |
| 8,060,955 | B2 * | 11/2011 | Johnson | A47K 3/30 | 4/557 |
| 2014/0259363 | A1 * | 9/2014 | Ball | A47K 3/34 | 4/607 |
| 2015/0113724 | A1 * | 4/2015 | Corpuz, Jr. | A47K 3/36 | 4/607 |

* cited by examiner

SLIDING RAIL TYPE LOW-OBSTACLE LINKAGE SHOWER ROOM AND INSTALLATION METHOD

CROSS REFERENCE TO RELATED APPLICATIONS

This application is based upon and claims priority to Chinese Patent Application No. 201610313071.6 filed on May 12, 2016, the entire contents of which are incorporated herein by reference.

TECHNICAL FIELD

The present invention relates to the sanitary ware industry, and particularly relates to a sliding rail low-obstacle linkage shower room and an installation method thereof.

BACKGROUND

The current sliding type linkage shower room includes two sliding types. One is a sliding movement by means of a pulley assembly, which slides on the ground with a low-obstacle or obstacle-free movement. However, the current pulley assembly easily rots and rusts with water, leading to an unsmooth slide which needs strong propulsion for the sliding movement. Thus, the market feedback is poor. The other one is a sliding rail movement, i.e., the glass of a shower room is glidingly provided within the sliding rail to form a linkage movement. In view of the sliding impact noise, the glass easily shaking, and an unstable movement, a fixed block is needed to be provided on the lower rail to prevent the glass from shaking while sliding. However, because of the large size of the fixed block, a lower frame body is provided in the current shower room to hide the fixed block. The height of the frame body is at least 50 mm, which is inconvenient for the elders or children to get in/out and makes them stumble. Further, there are at least two lower rails in the current linkage shower room, which makes the width across the lower rails even wider for the users to cross over and much more inconvenient for moving in and out. In addition, it's very inconvenient to install the current shower room, especially debugging (i.e., the adjustment of the overlapping region between the two pieces of glass) is cumbersome. The current linkage shower room is installed from the side. Once the left frame body and the right frame body are fixed inside the wall, it is difficult to adjust and repair them. The adjustments and repairs need to be done from the side, i.e., the door of the shower room should be removed and disassembled, so as to be adjusted, repaired, and replaced. Furthermore, a double-side upper rail within the upper frame body of the current linkage shower room is provided, and there is an upper frame body baffle provided from the front, so that the current linkage shower room cannot be installed from the front and modularly, and need to be installed from the side of the rail. Particularly, since the e-commerce service (online shopping) is developing nowadays, it is impossible for the users to install and adjust it on their own after purchase. Due to above reasons, the current linkage mechanism is unable to meet the needs of the usage and installation.

SUMMARY OF THE PRESENT INVENTION

The objective of the present invention is to solve the existing problems and provide a sliding rail low-obstacle linkage shower room and an installation method thereof. The linkage shower room has a simple structure which can be easily manufactured. A low-obstacle sliding rail is designed to facilitate the users to move in and out, which has a height as low as 10 mm. In addition, the shower room is modularly and easily installed with a single rail with a C-shaped section, without a positioning and limiting structure. The shower room has a low noise and an easy linkage between the primary shower glass and the secondary shower glass. Further, the shower room slides smoothly and stably, and can be installed, adjusted, repaired and disassembled handily, and thus the requirements for the usage and assemblage are easily met.

To fulfill the objective above, the present invention provides the following technical solutions:

A sliding rail low-obstacle linkage shower room, including an upper rail and a lower rail, fixed glass, primary shower glass and secondary shower glass. The lower rail is fixed on a bottom of the secondary shower glass, a sliding block unit is installed on the lower rail. The sliding block unit includes a fixed portion, a sliding groove and a guidance sliding portion. The fixed portion is fixed on the bottom of the secondary shower glass, a bottom of the primary shower glass is inserted into the sliding groove to form a linkage. The guidance sliding portion is glidingly engaged with the lower rail. Wherein, a linkage movement mechanism is installed inside the upper rail. While the primary shower glass is driven to move by a user, the linkage movement mechanism drives the primary shower glass to form an engagement linkage with the secondary shower glass. The secondary shower glass moves and makes the sliding block unit, which is removably connected to the secondary shower glass, move synchronously.

Further, an elastic holder is set within the sliding groove. The elastic holder is installed on the inner side wall of the sliding groove to hold the primary shower glass.

Further, the linkage movement mechanism includes a first gear rack, a second gear rack, a primary gear, a secondary gear and a connection frame body. The first gear rack is installed inside the upper rail, and the second gear rack is installed inside the connection frame body, which is removably connected to the primary shower glass. The primary gear is set within the connection frame body and engaged and linked with the first gear rack. The secondary gear is removably connected to the secondary shower glass and engaged with the first gear rack. The second gear rack within the connection frame body is engaged with the secondary gear. While the primary shower glass is driven to move by a user, the primary gear thereon is engaged and linked with the first gear rack, and the second gear rack engaged with the secondary gear also moves and thus drives the secondary gear which is engaged with both the first gear rack and the second gear rack to move, so that the primary shower glass and the secondary shower glass move as a linkage.

The shower room further includes eccentric adjusting structures, which are provided provided at the joint of the primary gear and the primary shower glass, the joint of the secondary gear and the secondary shower glass, and between the sliding block unit and the secondary shower glass respectively. The eccentric adjusting structures are split type eccentric structures. Each eccentric structure includes a lock cap, an eccentric block and a lock fastener engaged with the lock cap. The lock cap includes a rotational adjusting portion and a protrusion which is set eccentrically. The eccentric block goes through the primary shower glass and the secondary shower glass. The rotational adjusting portion is driven to turn and drive the protrusion which fits the eccentric block, to form an eccentric displacement, which further drives the primary shower glass and the secondary shower glass linked with the eccentric block to move upward and downward so that the primary gear and the secondary gear are detached from or engaged with the first gear rack.

Further, the upper rail is a rail with a C-shaped section. The embedded groove is form on a top of a left frame body and the right frame body for installing the upper rail with C-shaped section.

Further, the primary gear and the secondary gear are positioned toward the embedded groove.

A method of installing the sliding rail low-obstacle linkage shower room, including the following steps:

The first step is installing the rails. The upper rail and the lower rail are respectively installed on the upper frame body and the ground. Wherein, the lower rail is only installed corresponding to the secondary shower glass.

The second step is installing the gear racks. The first gear rack and the second gear rack are respectively installed within the upper rail and the connection frame body.

The third step is assembling the gears. The primary gear is built in the connection frame body, and the primary gear, the connection frame body and the primary shower glass are removably connected by the eccentric adjusting structure. The secondary gear is connected to the secondary shower glass by the eccentric adjusting structure.

The fourth step is installing the sliding block unit. The fixed portion of the sliding block unit is connected to the secondary shower glass by the eccentric adjusting structure.

The fifth step is installing the whole shower room. Firstly, a position of opening the door is chosen and the fixed glass is installed in a fixed way. Subsequently, the secondary shower glass is hung on the first gear rack from the front to make the secondary gear engage with the first gear rack and the guidance sliding portion of the sliding block unit fixed at the bottom of the secondary shower glass fits the lower rail. Finally, the primary shower glass is also hung on the first gear rack in the same manner so that the primary gear is engaged with the first gear rack and the second gear rack within the connection frame body is engaged with the secondary gear on the secondary shower glass.

The sixth step is adjusting the gap. The primary shower glass and the secondary shower glass are adjusted and raised to disengage from the first gear rack by driving the eccentric adjusting structures, and the overlapping region between two pieces of glass therefore can be arbitrarily adjusted. The eccentric adjusting structures are driven and reset after the adjustment and the primary shower glass and the secondary shower glass are both engaged with the first gear rack.

Compared with the prior art, the present invention has the beneficial effects as below:

(1) The present invention provides a sliding rail low-obstacle linkage shower room and an installation method, with a simple structure which is easily manufactured. It is fit for the limited shower space and makes the door open wide enough for the pregnant women and obese people moving in and out. Additionally, the present invention adopts a design of a low-obstacle sliding rail, with a height decreased to 10 mm which is much less than the height of 50 mm in the prior art. There is no rail at the position of the primary shower glass, facilitating the users to move in and out without stumbling. The sliding block unit for preventing the linkage shower glass from shaking when opening and closing also moves back and forth when opening and closing. As well, an elastic holder is adopted to decrease the noise of the sliding impact, prevent the shower glass from shaking and ensure a stable movement. It further ensures that the primary shower glass and the secondary shower glass would not detach off easily when opening and closing.

(2) The linkage movement mechanism on the upper rail of the present invention is simple and installed modularly with few parts and simple connectors, which is provided without a positioning and limiting structure, thus eliminating the noise thereof. A complete engagement by means of the gear engagement structure and the gravity of the primary and secondary shower glass is realized, failing to detach off easily and thus the users are free from worry of the scenarios, such as toppling, due to the incomplete engagement. Only a modular installation is needed for the users, without the linkage debugging for each part. For the existing online shopping users, the installation steps are simplified and it can be installed on their own, without the onsite installation services by the professionals, which makes the linkage shower room of the present invention more competitive.

(3) The split type eccentric adjusting structures provided on the shower glass, compared with the current integrated eccentric structures, can decrease the hole dimension, eliminating the effects on the service life of the shower glass due to the large hole dimension. In addition, a deviation resulting from the large hole dimension, leading to a difficult installation is prevented. Furthermore, while adjusting the overlapping region of the glass, the user only needs to drive the eccentric adjusting structures externally to make the shower glass detached from the upper rail and then make a displacement adjustment subsequently, which is much simpler than that in the prior art.

(4) Instead of the traditional dual-rail sliding type, a monorail and a mono-pulley structure are adopted in the present invention, thus the cost is reduced and the obstacle-free installation from the front is realized, which facilitates the modular installation and adjustment.

(5) The installation method of the present invention is simple and quick. An engagement is made by hanging upward lightly after the assembly, without an adjustment by a special tool. The users are also free from worry of incomplete engagement. The overlapping region can be adjusted after the glass being easily lifted. It also has a long service life.

BRIEF DESCRIPTION OF THE DRAWINGS

The accompanying drawings herein are provided for further understanding of the present invention and constitute a part of the present invention. The schematic embodiments and the description thereof are used to explain the present invention, and are not used to limit the present invention improperly. In the accompany drawings.

DETAILED DESCRIPTION OF THE PRESENT INVENTION

To solve the technical problems and make the technical solutions and the beneficial effects more clear and explicit, the present invention is further described as below with reference to the accompany drawings and the embodiments. It is appreciated that the embodiments herein are only used to explain the present invention and are not intended to limit the present invention.

Figure 1:
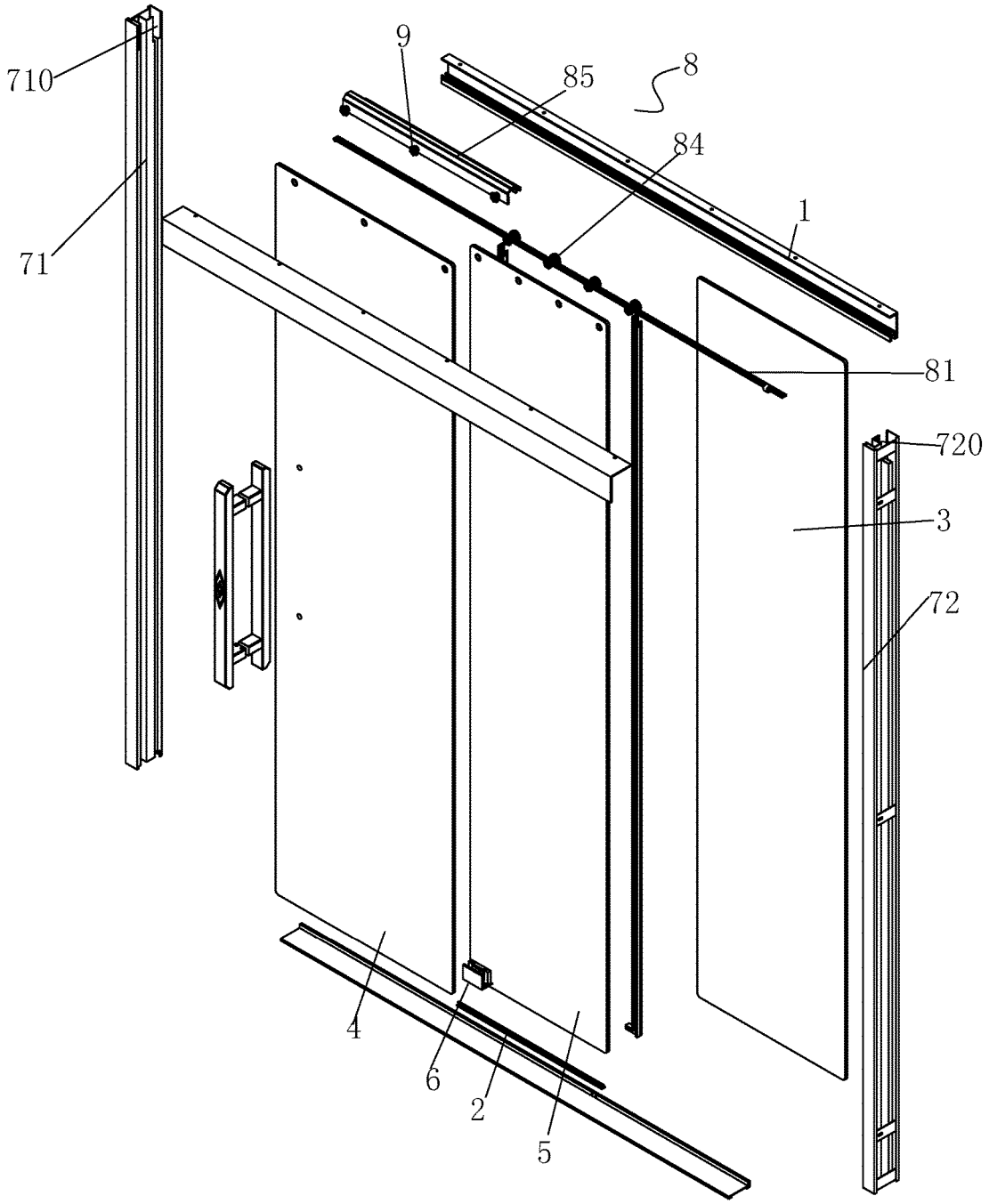
FIG. 1 is an exploded structural schematic stereogram of a linkage shower room of the present invention.
Figure 2:
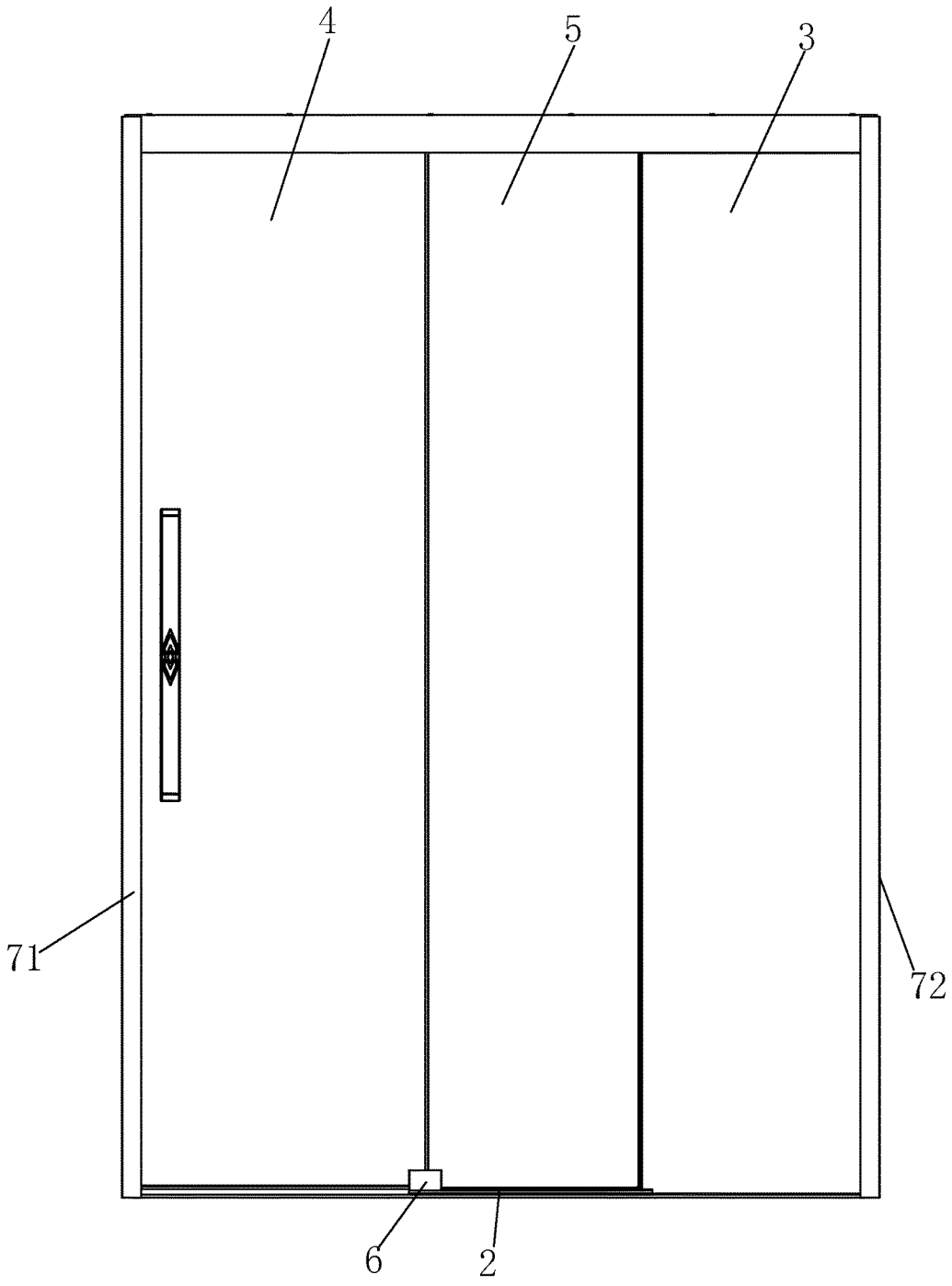
FIG. 2 is a front view of the linkage shower room of the present invention.

As shown in FIG. 1 and FIG. 2, the present invention discloses a sliding rail low-obstacle linkage shower room, including an upper rail 1 and a lower rail 2, a fixed glass 3, a primary shower glass 4 and a secondary shower glass 5. The lower rail 2 is correspondingly provided at the secondary shower glass 5. The sliding block unit 6 is installed on the secondary shower glass 5. The upper rail 1 is an open upper rail 1 with a C-shaped section, i.e., upper rail 1 is open from the front, without a baffle, so that fixed glass 3 and primary shower glass 4 can be installed from the front of upper rail 1. The left frame body 71 and right frame body 72 are provided with the embedded grooves 710 and 720 respectively for the receiving upper rail 1.

Figure 7:
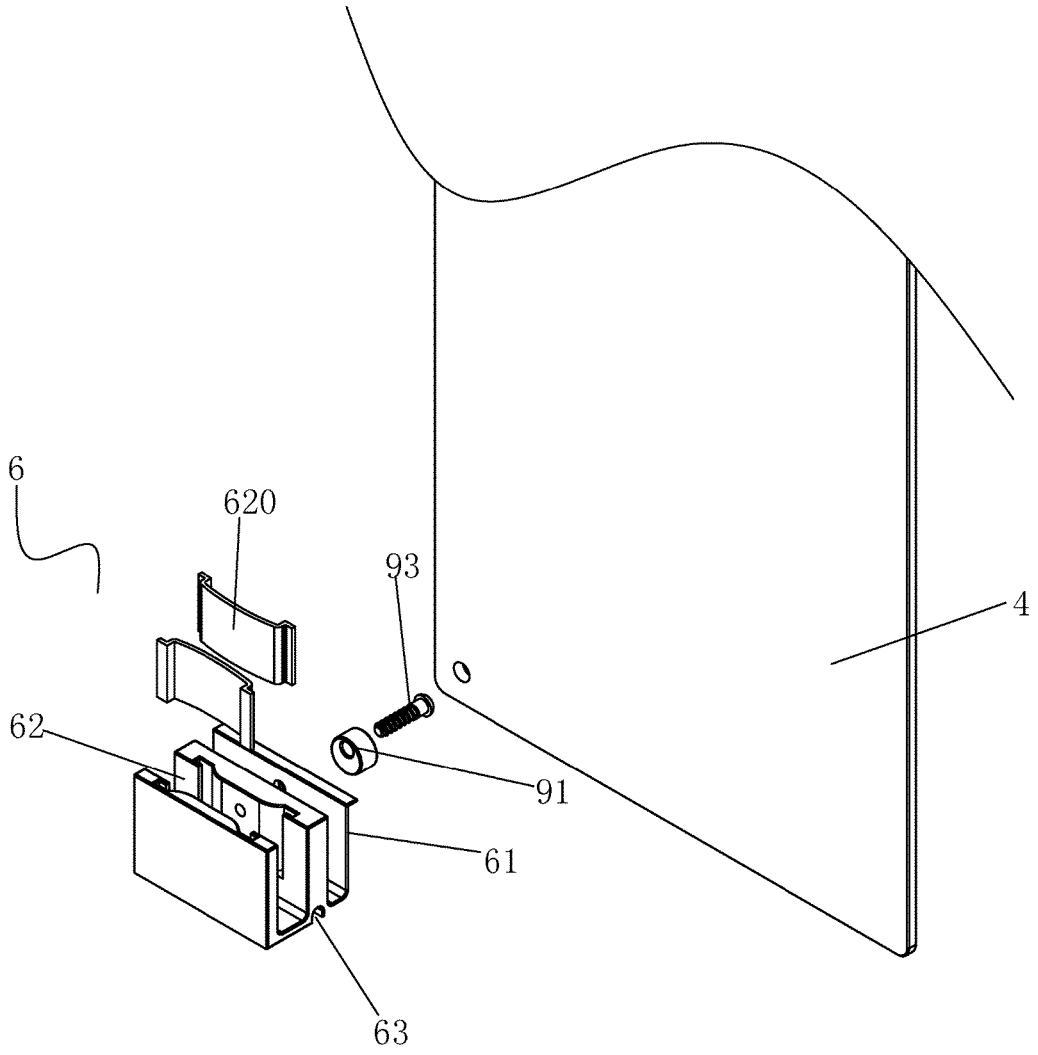
FIG. 7 is a structural schematic installation view of a sliding block unit of the present invention.
Figure 8:
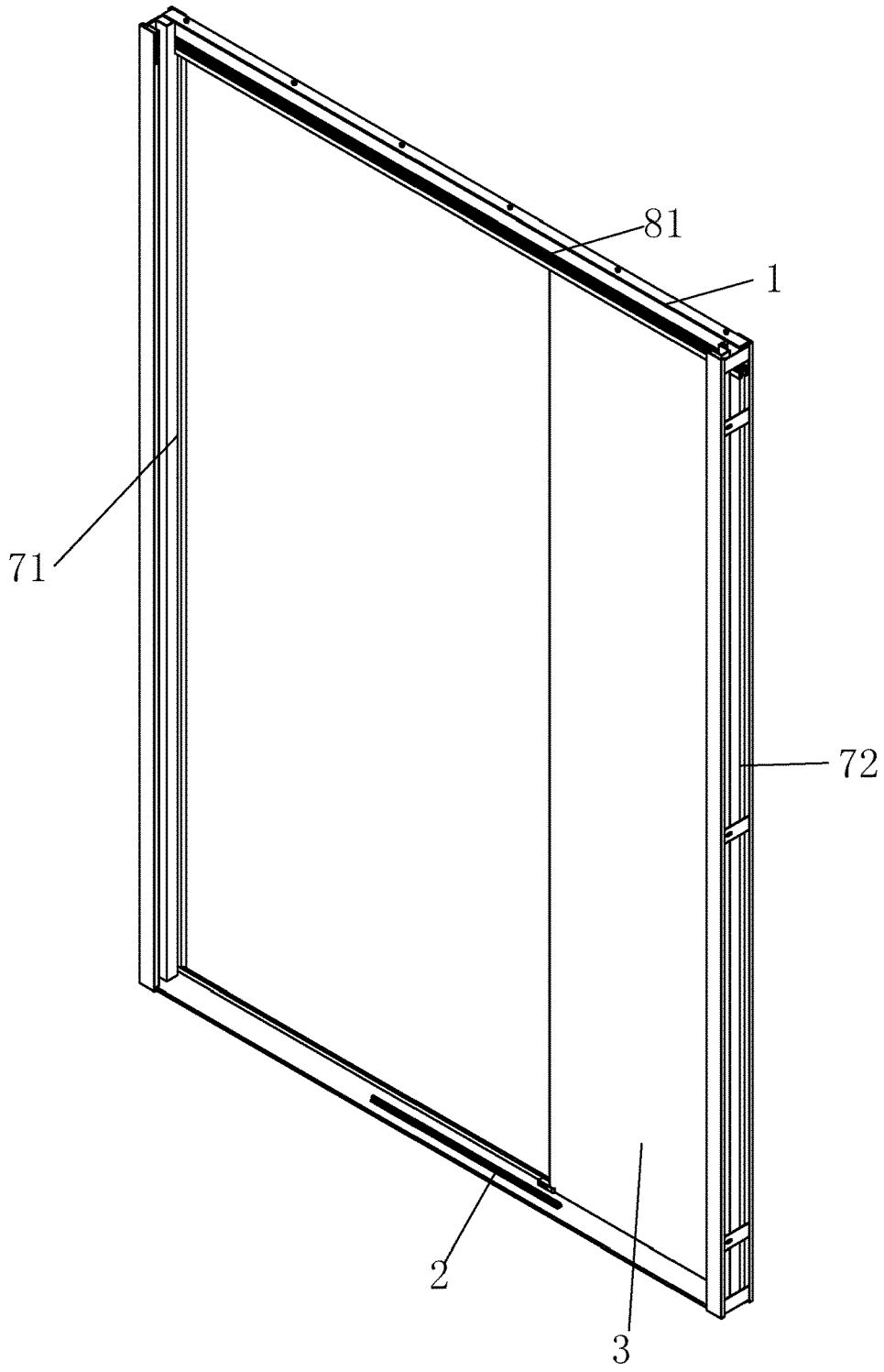
FIG. 8 is a structural schematic installation view of a frame body and fixed glass of the present invention.

The sliding block unit 6, as shown in FIG. 7, includes a fixed portion 61, a sliding groove 62 and a guidance sliding portion 63. The fixed portion 61 is provided correspondingly to the secondary shower glass 5. The sliding groove 62 is used for receiving the primary shower glass 4 to form a linkage. An elastic holder 620 is provided within the sliding groove 62. The elastic holder 620 is provided on the inner side wall of the sliding groove 62 to hold the primary shower glass 4. The guidance sliding portion 63 is glidingly engaged with the lower rail 2.

The linkage movement mechanism 8 is provided on the upper rail 1. While the primary shower glass 4 is driven to move by a user, the linkage movement mechanism 8 on the upper rail 1 drives the primary shower glass 4 to form an engagement linkage with the secondary shower glass 5. The secondary shower glass 5 moves and in turn makes the sliding block unit 6, which is removably connected to the secondary shower glass 5, move synchronously.

Figure 3:
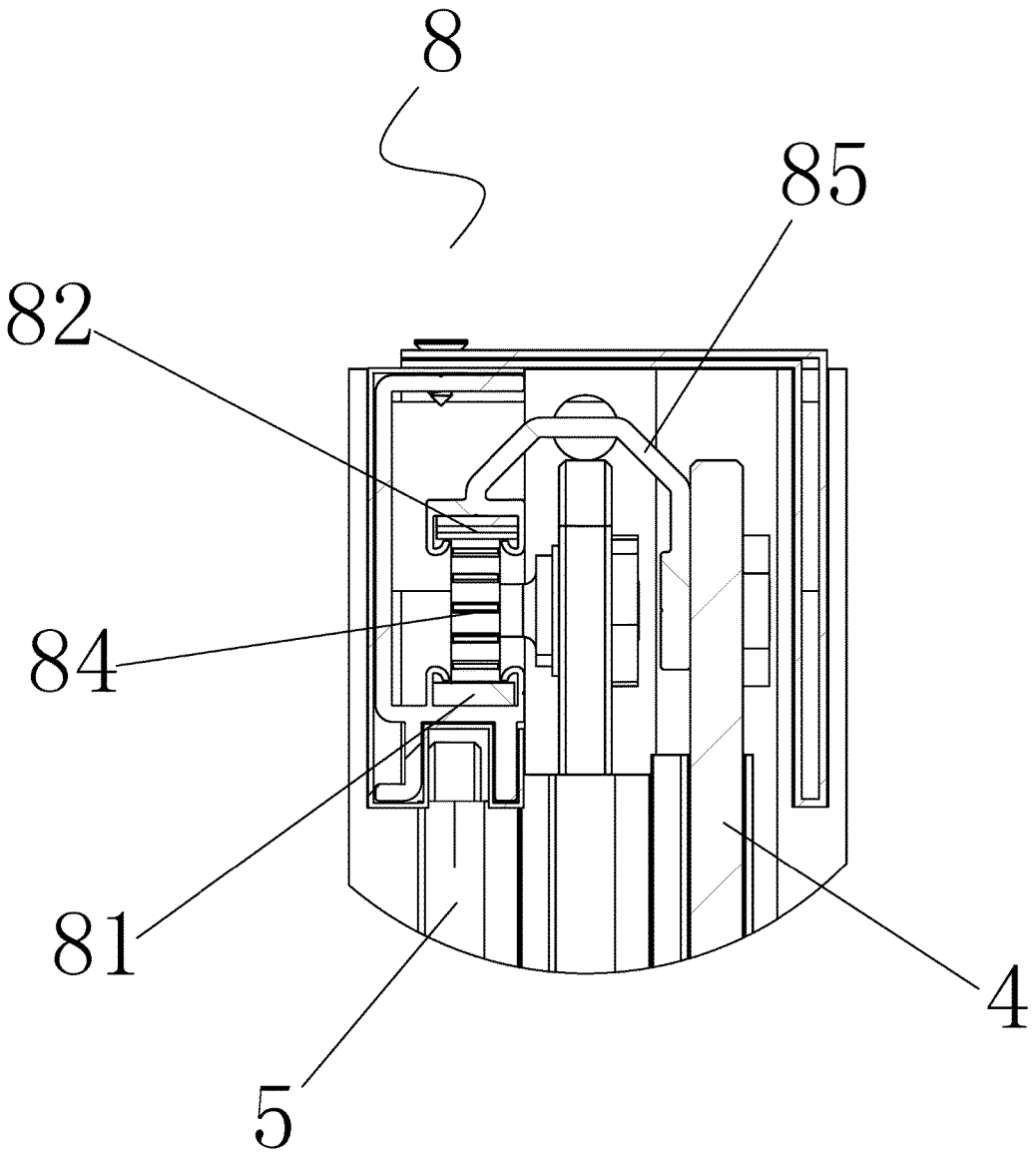
FIG. 3 is a partial sectional view of a linkage movement mechanism.
Figure 5:
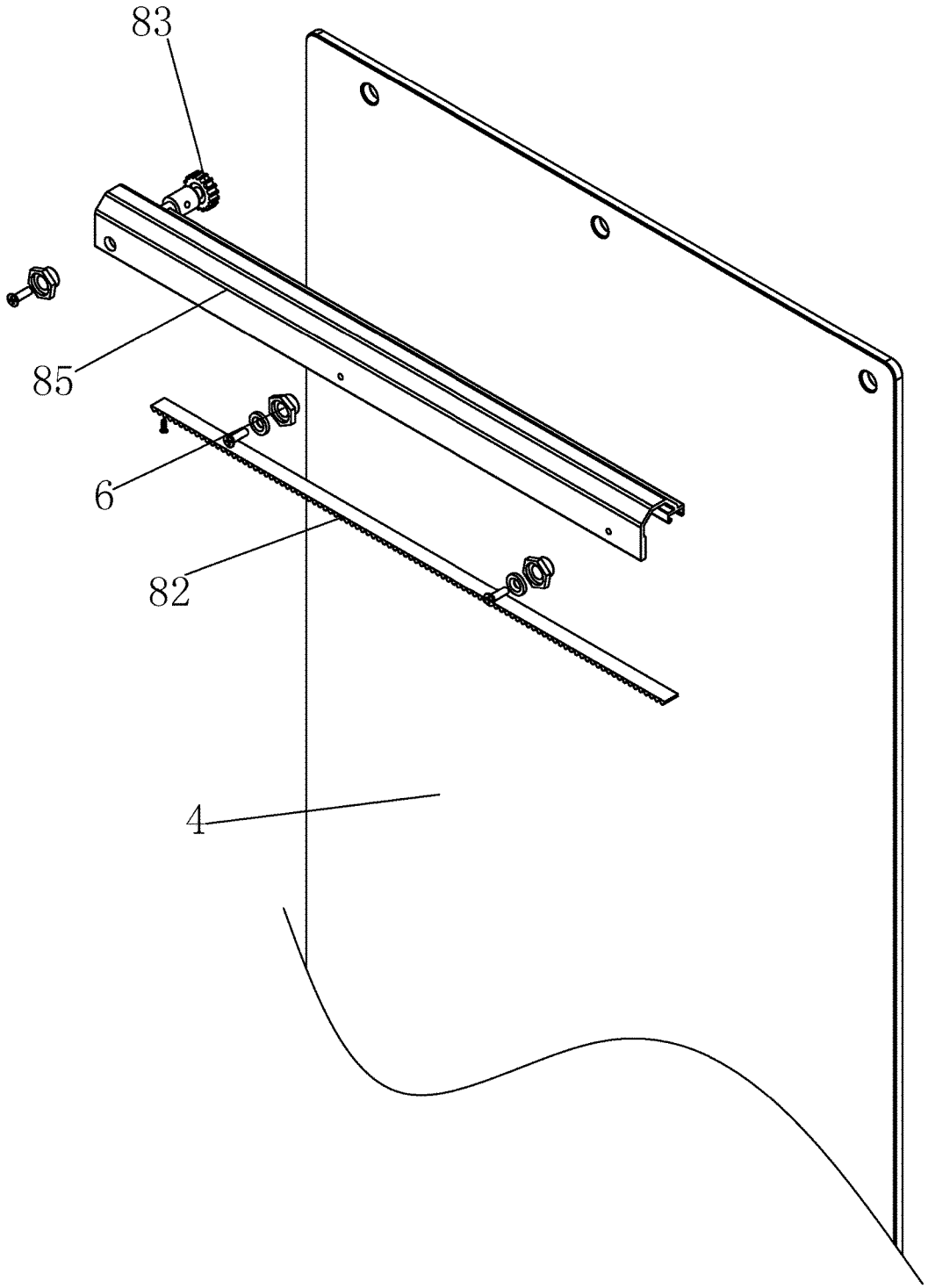
FIG. 5 is a structural schematic installing view of a gear and the connection frame body of the present invention.

More specifically, as shown in FIG. 3 and FIG. 5, the linkage movement mechanism 8 includes a first gear rack 81, a second gear rack 82, a primary gear 83, a secondary gear 84 and a connection frame body 85. The primary gear 83 and the secondary gear 84 are positioned toward the embedded groove. The first gear rack 81 is covered by the upper rail 1, and the second gear rack 82 is built on the inner top surface of the connection frame body 85 which is removably connected to the primary shower glass 4. The primary gear 83 is provided within the connection frame body 85 and engaged with the first gear rack 81. The secondary gear 84 is removably connected to the secondary shower glass 5 and engaged with the first gear rack 81. The second gear rack 82 within the connection frame body 85 is engaged with the secondary gear 84. While the primary shower glass 4 is driven to move, the primary gear 83 thereon is engaged and linked with the first gear rack 81, and the second gear rack 82 engaged with the secondary gear 84 also moves, which drives the secondary gear 84 engaged with both the first gear rack 81 and the second gear rack 82 to move, so that the primary shower glass 4 and the secondary shower glass 5 move as a linkage.

Figure 6:
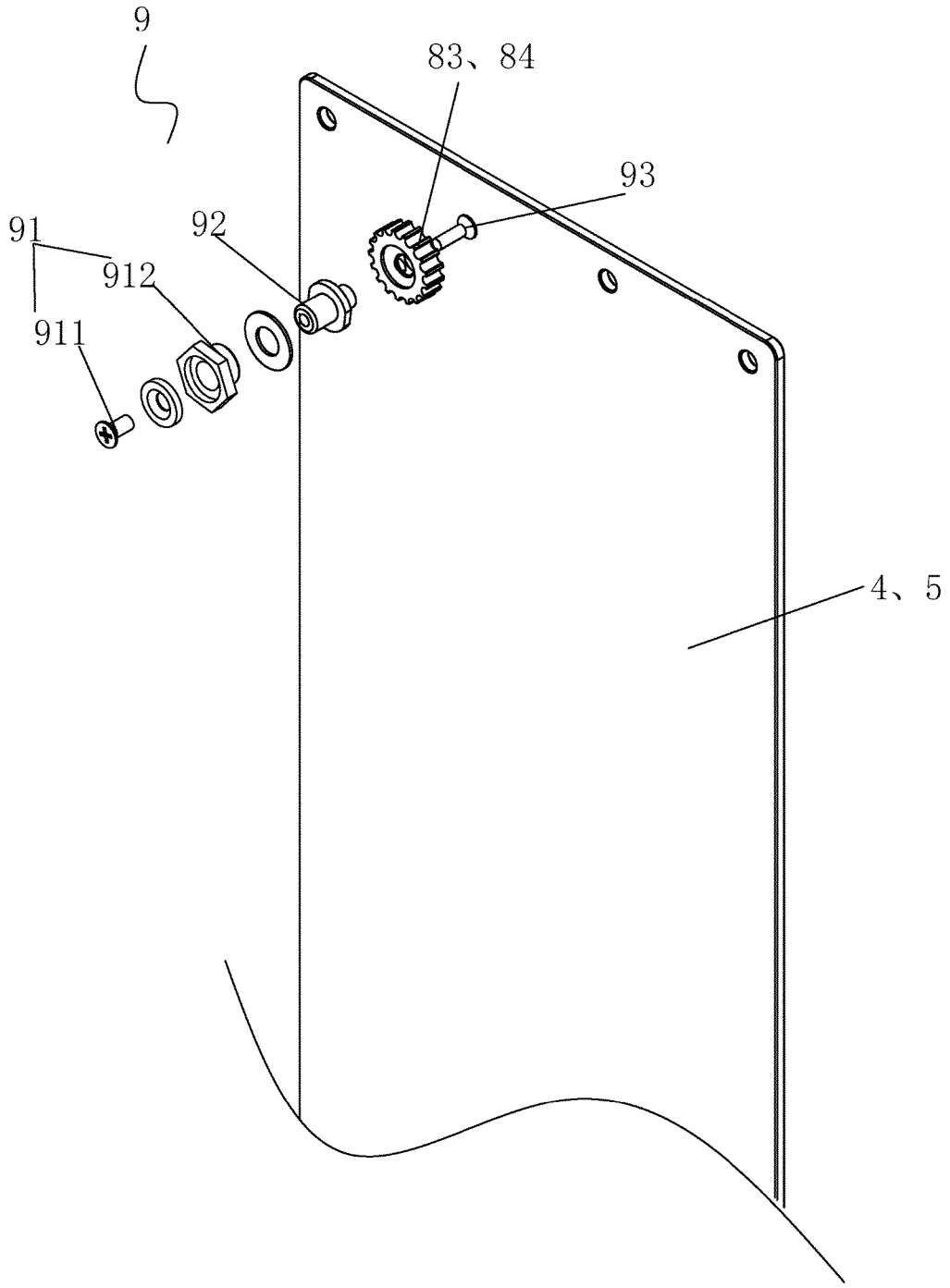
FIG. 6 is a schematic installation view of a split type eccentric structure of the present invention.

More specifically, as shown in FIG. 6, the shower room further includes eccentric adjusting structures 9, which are provided at the joint of the primary gear 83 and the primary shower glass 4, the joint of the secondary gear 84 and the secondary shower glass 5, and between the sliding block unit 6 and the secondary shower glass 5 respectively. The eccentric adjusting structures 9 are split type eccentric structures, each of which includes a lock cap 91, an eccentric block 92 and a lock fastener 93 engaged with the lock cap 91. The lock cap 91 includes a rotational adjusting portion 911 and a protrusion 912 which is set eccentrically. The eccentric block 92 goes through the primary shower glass 4 and the secondary shower glass 5. Wherein, the rotational adjusting portion 911 is driven to turn and drives the protrusion 912 which is engaged with the eccentric block 92 to form an eccentric displacement, which in turn makes the primary shower glass 4 and the secondary shower glass 5 linked with the eccentric block 92 move upward and downward, so that the primary gear 83 and the secondary gear 84 are detached from or engaged with the first gear rack 81.

An embodiment (as shown in FIG. 1 to FIG. 11) of the present invention provides a sliding rail low-obstacle linkage shower room, mainly including the following parts: a upper frame body 73, a left frame body 71, a right frame body 72, a upper rail 1, a lower rail 2, a fixed glass 3, a primary shower glass 4, a secondary shower glass 5, a sliding block unit 6, a first gear rack 81, a second gear rack 82, a primary gear 83, a secondary gear 84, a connection frame body 85, a lock cap 91, a eccentric block 92 and a lock fastener 93.

The specific installation method includes the following steps:

The first step is installing the rails (as shown in FIG. 1 to FIG. 3). A direction of opening the door (opening leftward or opening rightward) is chosen by the user. Subsequently, the rails are prepared and the height of the rails is set. The upper rail 1 and the lower rail 2 are respectively installed on the upper frame body 73 and the ground. Wherein, the lower rail 2 is only installed corresponding to the secondary shower glass 5.

Figure 4:
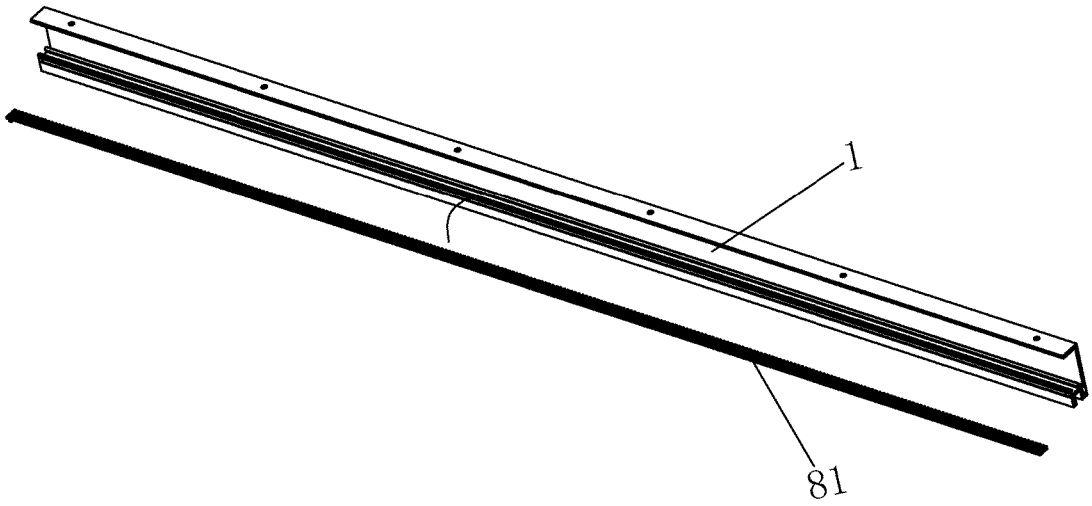
FIG. 4 is a schematic installing view of an upper rail for the linkage shower room of the present invention.

The second step is installing the gear racks (as shown in FIG. 4). The first gear rack 81 and the second gear rack 82 are respectively installed within the upper rail 1 and the connection frame body 85. The length of the first gear rack 81 stretches across the overall length of the whole shower room, while the length of the second gear rack 82 only corresponds to the length of the secondary shower glass 5.

The third step is assembling the gears (as shown in FIGS. 5, 6 and 7). The primary gear 83 is built in the connection frame body 85. The primary gear 83, the connection frame body 85 and the primary shower glass 4 are removably connected by the eccentric adjusting structure 9. The secondary gear 84 is connected to the secondary shower glass 5 by the eccentric adjusting structure 9. The primary gear 83 is only installed on the primary shower glass 4 on the end of the primary glass 4 away from the secondary shower glass 5. The primary gear 83 is not engaged with the second gear rack 82, i.e., a space for placing the primary gear 83 is formed within the connection frame body 85. In addition, the connection by the eccentric adjusting structure 9 is a pre-tighten connection. The rotational adjusting portion 911 on the lock cap 91 is driven again and drives the protrusion 912 which is engaged with the eccentric block 92 to form an eccentric displacement. After a horizontal position being measured, the lock fastener 93 and the lock cap 91 are connected and locked, so that the primary gear 83, and the secondary gear 84 are respectively connected to the primary shower glass 4 and the secondary shower glass 5.

The fourth step is installing sliding block unit 6 (as shown in FIG. 7). The sliding block unit 6 is also installed in the same manner as the gears. The fixed portion 61 of the sliding block unit 6 is connected to the secondary shower glass 5 by the eccentric adjusting structure 9. The parts on the primary shower glass 4 and the secondary shower glass 5 are then all assembled.

The fifth step is installing the whole shower room (as shown in FIG. 8 to FIG. 11). Firstly, a direction of opening the door is chosen. The fixed glass 3 is installed in a fixed way. Subsequently, the secondary shower glass 5 is hung on the first gear rack 81 from the front to make the secondary gear 84 engage with the first gear rack 81. Also, the guidance sliding portion 63 of the sliding block unit 6 fixed at the bottom of the secondary shower glass 5 is correspondingly engaged with the lower rail 2, and thus the secondary shower glass 5 is assembled. Finally, the primary shower glass 4 is also hung on the first gear rack 81 in the same manner so that the primary gear 83 is engaged with the first gear rack 81 (the primary gear 83 is not engaged with the second gear rack 82). Further, the second gear rack 82 within the connection frame body 85 is engaged with the secondary gear 84 on the secondary shower glass 5, such that the gravity of the primary shower glass 4 is supported on the first gear rack 81 and the secondary gear 84 of the secondary shower glass 5. In this manner, adjustment is easily made, the cost is saved and primary shower glass 4 is not easily disengaged. Besides, the bottom of the primary shower glass 4 is embedded and fixed in the sliding groove 62 of the sliding block unit 6 at the bottom of the secondary shower glass 5. The shake and noise are prevented when the primary shower glass 4 slides relative to the secondary shower glass 5 by means of the elastic holder 620 of the sliding groove 62.

Figure 9:
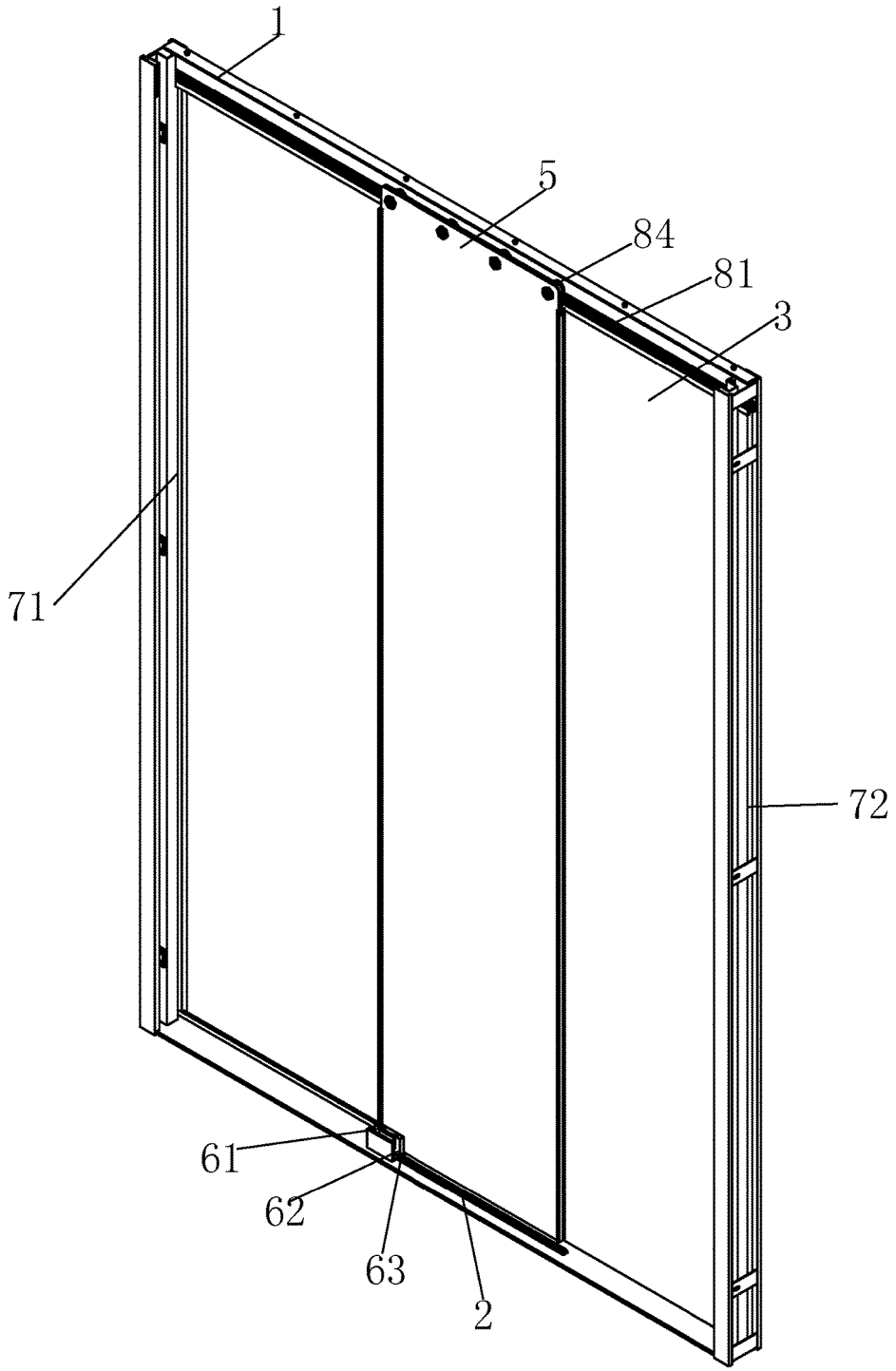
FIG. 9 is a structural schematic installation view of secondary shower glass of the present invention.
Figure 10:
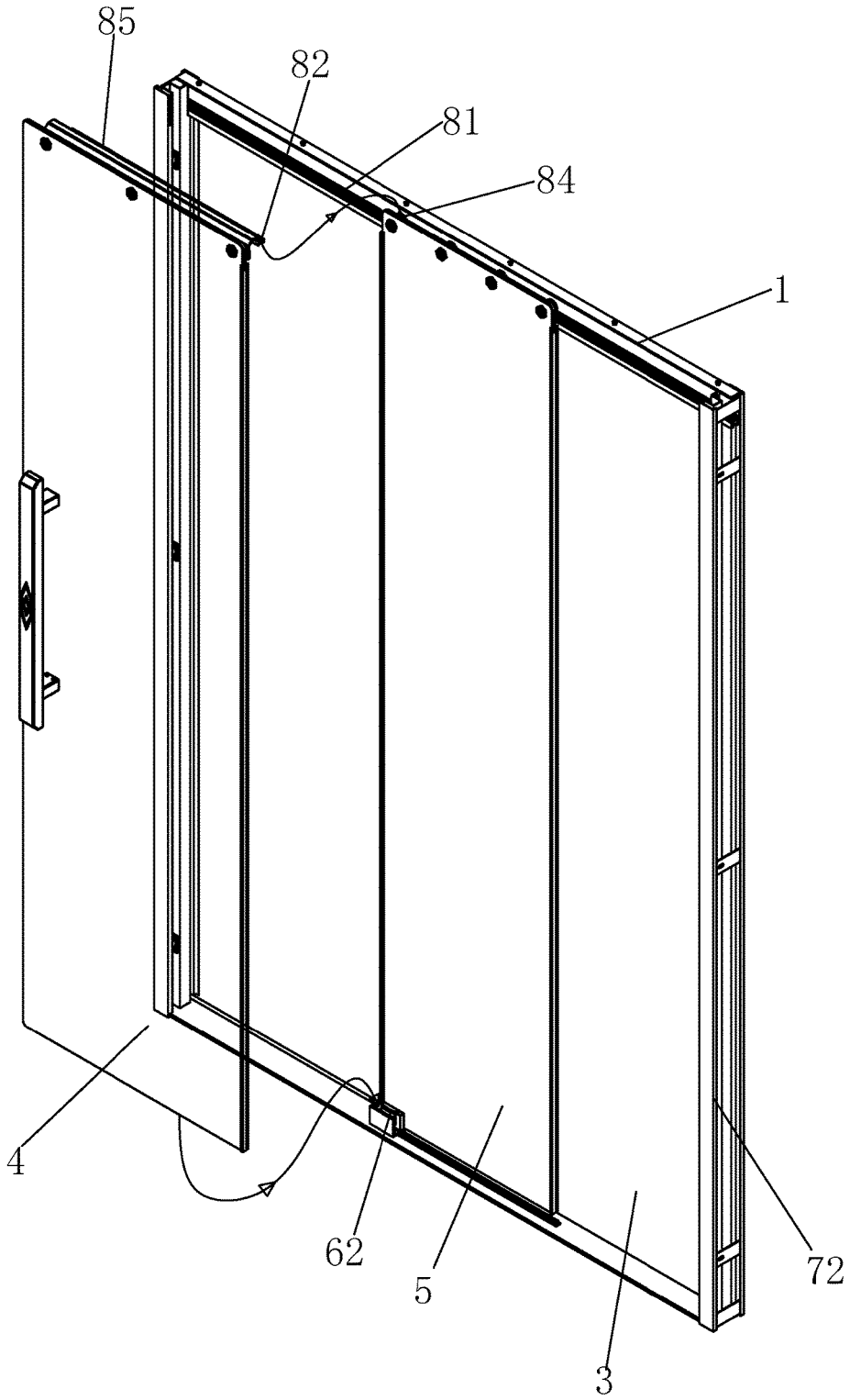
FIG. 10 is a structural schematic installation view of primary shower glass of the present invention.
Figure 11:
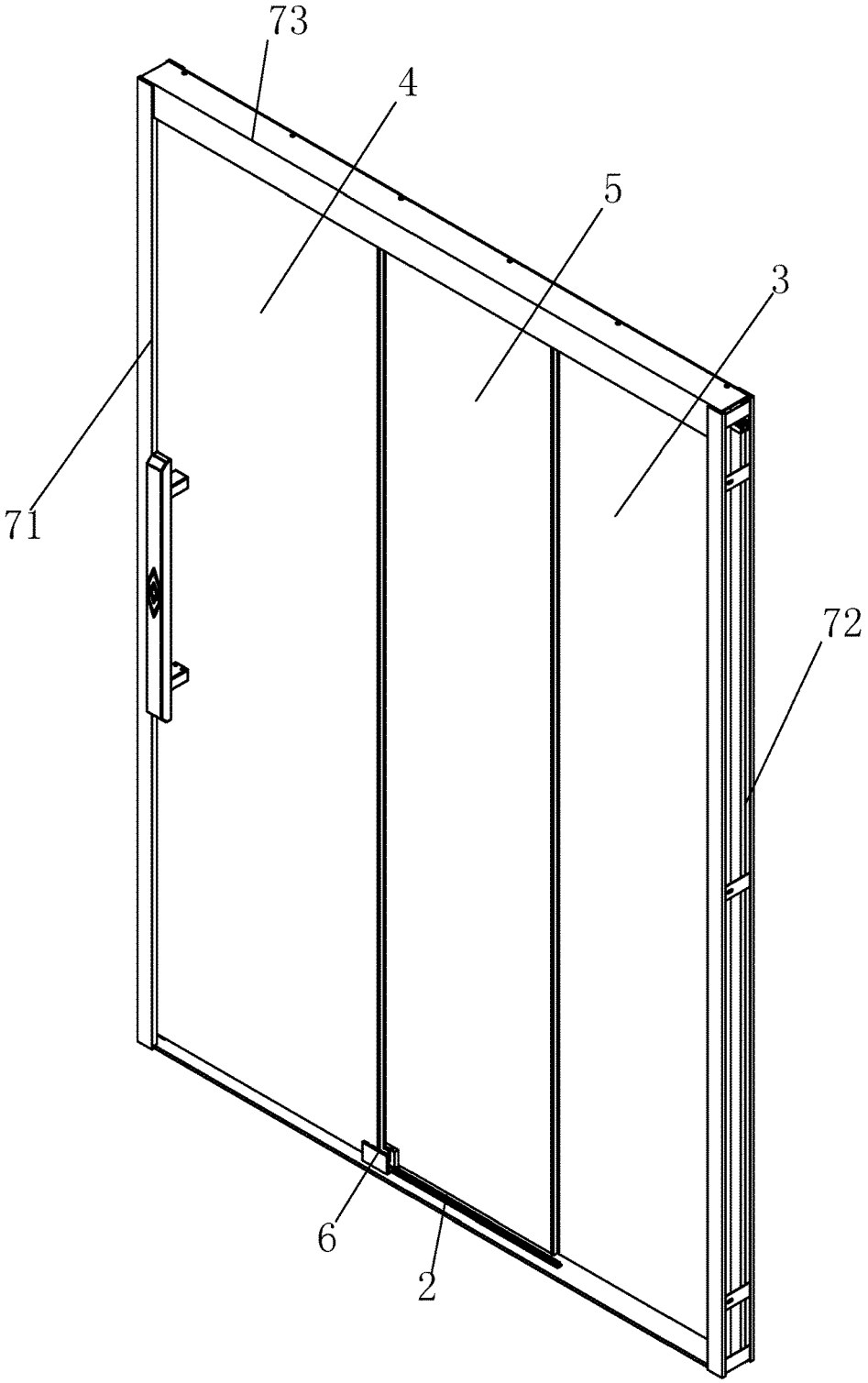
FIG. 11 is an overall structural schematic installation view of the present invention.

The sixth step is adjusting the gap (as shown in FIG. 9 to FIG. 11). The gap adjustment is for adjusting the overlapping region between two adjacent pieces of glass. The adjustment is the most difficult in the current linkage mechanism. In the present invention, an end of the primary shower glass 4 which is close to secondary shower glass 5 is directly lifted, so that the primary shower glass 4 slopes upward and disengages from the sliding groove 62. A displacement adjustment is subsequently made, followed by placing the primary shower glass 4 into the sliding groove 62, and thus a displacement adjustment is completed. Furthermore, the primary shower glass 4 and the secondary shower glass 5 are adjusted and raised to disengage from the first gear rack 81 by driving the eccentric adjusting structures 9 and the overlapping region between two pieces of glass therefore can be arbitrarily adjusted. The eccentric adjusting structures are driven and reset after adjustment and the primary shower glass 4 and the secondary shower glass 5 are both engaged with the first gear rack 81. Finally, a decorative cover is provided on the upper frame body 73, and then the whole installation process is completed.

The present invention provides a sliding rail low-obstacle linkage shower room and an installation method, with a simple structure which is easily manufactured. It is fit for the limited shower space and makes the door open wide enough for the pregnant women and obese people moving in and out. Additionally, the present invention adopts a design of a low-obstacle sliding rail, with a height decreased to 10 mm which is much less than the height of 50 mm in the prior art. There is no rail at the position of the primary shower glass, facilitating the users to move in and out without stumbling. The sliding block unit for preventing the linkage shower glass from shaking while opening and closing also moves back and forth when the linkage shower glass is opened and closed. As well, an elastic holder is adopted to reduce the noise of the sliding impact, and prevent the shower glass from shaking and ensure a stable movement. It further ensures that the primary shower glass and the secondary shower glass would not detach off easily when the linkage shower glass is opened and closed. The linkage movement mechanism on the upper rail of the present invention is simple and can be installed modularly with few parts and simple connectors, which is provided without a positioning or limiting structure, and thus the noise caused by the positioning or limiting structure is eliminated. A complete engagement is realized by means of the gear engagement structure and the gravity of the primary and secondary shower glass, which avoids detaching off. Thus, the users are free from worry of the scenarios, such as toppling due to the incomplete engagement. Only a modular installation is needed for the users, without the linkage debugging for each part. For the existing online shopping users, the installation steps are simplified and can be done by the users on their own, without the onsite installation services by the professionals, which makes the linkage shower room of the present invention more competitive. The split type eccentric adjusting structures provided on the shower glass, compared with the current integrated eccentric structures, can decrease the hole dimension and eliminate the effects on the service life of the shower glass due to the large hole dimension. In addition, a deviation resulting from the large hole dimension, leading to a difficult installation is prevented. Furthermore, while adjusting the overlapping region of the glass, the user only needs to drive the eccentric adjusting structures externally to make the shower glass detach from the upper rail and then make a displacement adjustment subsequently, which is much simpler than that in the prior art. Instead of the traditional dual-rail sliding type, a monorail and a mono-pulley structure are adopted in the present invention, thus the cost is reduced and the obstacle-free installation from the front is realized, which facilitates the modular installation and adjustment. The installation method of the present invention is simple and quick. An engagement is made with hanging upward lightly after the assembly, without an adjustment by a special tool. The users are also free from worry of incomplete engagement. The overlapping region can be adjusted after the glass being easily lifted. It also has a long service life.

The preferable embodiments of the present invention are illustrated and described as above. As previously mentioned, it is understood that the present invention is not limited to what is disclosed herein and is not intended to exclude the other embodiments. The present invention can be used in any other combinations, modifications and situations, and can be modified within the conception scope of the present invention, based on the above teachings, and the technology or knowledge in the related art. Without departing from the spirit and scope of the present invention, the modifications and changes would fall within protection scope of the claims appended to the present invention.

The invention claimed is:

1. A sliding rail low-obstacle linkage shower room, comprising:

an upper rail, a lower rail, a fixed glass, a primary shower glass and a secondary shower glass;

wherein the lower rail is fixed on a bottom of the secondary shower glass, a sliding block unit is installed on the lower rail;

wherein the sliding block unit includes a fixed portion, a sliding groove and a guidance sliding portion;

wherein the fixed portion is fixed on the bottom of the secondary shower glass, a bottom of the primary shower glass is inserted into the sliding groove to form a linkage, and the guidance sliding portion is glidingly engaged with the lower rail;

wherein a linkage movement mechanism is installed inside the upper rail, and the linkage movement mechanism drives the primary shower glass to form an engagement linkage with the secondary shower glass, and the secondary shower glass moves and makes the sliding block unit removably connected to the secondary shower glass move synchronously.

2. The sliding rail low-obstacle linkage shower room of claim 1, wherein an elastic holder is set within the sliding groove, and the elastic holder is installed on an inner side wall of the sliding groove to hold the primary shower glass.

3. The sliding rail low-obstacle linkage shower room of claim 1, wherein the linkage movement mechanism includes a first gear rack, a second gear rack, a primary gear, a secondary gear and a connection frame body, the first gear rack is installed inside the upper rail, and the second gear rack is installed inside the connection frame body which is removably connected to the primary shower glass, the primary gear is set within the connection frame body and engaged and linked with the first gear rack, and the secondary gear is removably connected to the secondary shower glass and engaged with the first gear rack;

wherein the second gear rack is engaged with the secondary gear, and the primary gear is engaged and linked with the first gear rack, and the second gear rack moves so as to drive the secondary gear to move, and the primary shower glass and the secondary shower glass move as a linkage.

4. The sliding rail low-obstacle linkage shower room of claim 2, wherein the linkage movement mechanism includes a first gear rack, a second gear rack, a primary gear, a secondary gear and a connection frame body, the first gear rack is installed inside the upper rail, and the second gear rack is installed inside the connection frame body which is removably connected to the primary shower glass, the primary gear is set within the connection frame body and engaged and linked with the first gear rack, and the secondary gear is removably connected to the secondary shower glass and engaged with the first gear rack;

wherein the second gear rack is engaged with the secondary gear, and the primary gear is engaged and linked with the first gear rack, and the second gear rack moves so as to drive the secondary gear to move, and the primary shower glass and the secondary shower glass move as a linkage.

5. The sliding rail low-obstacle linkage shower room of claim 3, further comprising eccentric adjusting structures, wherein the eccentric adjusting structures are set respectively at a joint of the primary gear and the primary shower glass, at a joint of the secondary gear and the secondary shower glass, and between the sliding block unit and the secondary shower glass;

wherein the eccentric adjusting structures are split eccentric structures, and each of the eccentric adjusting structures includes a lock cap, an eccentric block and a lock fastener fitting the lock cap;

wherein the lock cap includes a rotational adjusting portion and an eccentric protrusion, and the eccentric block passes through the primary shower glass and the secondary shower glass;

wherein the rotational adjusting portion is driven to turn so as to drives the eccentric protrusion; the eccentric protrusion and the eccentric block form an eccentric displacement, and make the primary shower glass and the secondary shower glass move upward and downward, so that the primary gear and the secondary gear are detached from or engaged with the first gear rack.

6. The sliding rail low-obstacle linkage shower room of claim 4, further comprising eccentric adjusting structures, wherein the eccentric adjusting structures are set respectively at a joint of the primary gear and the primary shower glass, at a joint of the secondary gear and the secondary shower glass, and between the sliding block unit and the secondary shower glass;

wherein the eccentric adjusting structures are split eccentric structures, and each of the eccentric adjusting structures includes a lock cap, an eccentric block and a lock fastener fitting the lock cap;

wherein the lock cap includes a rotational adjusting portion and an eccentric protrusion, and the eccentric block passes through the primary shower glass and the secondary shower glass;

wherein the rotational adjusting portion is driven to turn so as to drive the eccentric protrusion; the eccentric protrusion and the eccentric block form an eccentric displacement, and make the primary shower glass and the secondary shower glass move upward and downward, so that the primary gear and the secondary gear are detached from or engaged with the first gear rack.

7. The sliding rail low-obstacle linkage shower room of claim 5, wherein the upper rail is rail with a C-shaped section, and an embedded groove is form on a top of a left frame body and a right frame body for installing the upper rail.

8. The sliding rail low-obstacle linkage shower room of claim 6, wherein the upper rail is rail with a C-shaped section, and an embedded groove is formed on a top of a left frame body and a right frame body for installing the upper rail.

9. The sliding rail low-obstacle linkage shower room of claim 7, wherein the primary gear and the secondary gear are positioned toward the embedded groove.

10. The sliding rail low-obstacle linkage shower room of claim 8, wherein the primary gear and the secondary gear are positioned toward the embedded groove.

* * * * *